US008490563B1

(12) United States Patent
Shivers, III et al.

(10) Patent No.: US 8,490,563 B1
(45) Date of Patent: Jul. 23, 2013

(54) FLOATING LIQUEFACTION VESSEL

(75) Inventors: Robert Magee Shivers, III, Houston, TX (US); William T. Bennett, Jr., Houston, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

(21) Appl. No.: 13/190,527

(22) Filed: Jul. 26, 2011

Related U.S. Application Data

(63) Continuation-in-part of application No. 13/025,459, filed on Feb. 11, 2011, now Pat. No. 8,100,076, and a continuation-in-part of application No. 13/025,477, filed on Feb. 11, 2011, now Pat. No. 8,104,416, and a continuation-in-part of application No. 13/025,493, filed on Feb. 11, 2011, now Pat. No. 8,104,417, and a continuation-in-part of application No. 13/025,524, filed on Feb. 11, 2011, and a continuation-in-part of application No. 13/025,569, filed on Feb. 11, 2011, and a continuation-in-part of application No. 13/025,604, filed on Feb. 11, 2011.

(51) Int. Cl.

| | |
|---|---|
| ***B63B 21/50*** | (2006.01) |
| ***B63B 22/02*** | (2006.01) |
| ***B63B 22/26*** | (2006.01) |
| ***B63B 27/34*** | (2006.01) |
| ***B63H 25/00*** | (2006.01) |
| ***F17C 7/02*** | (2006.01) |

(52) U.S. Cl.
USPC ..... 114/230.14; 114/230.17; 441/4; 141/387; 62/50.1; 62/53.2

(58) Field of Classification Search
USPC ..... 114/230.1, 230.13–230.18; 441/3–5; 62/50.1–50.7, 53.2, 611–614; 141/279, 387, 141/388; 137/615; 14/69.5, 71.1–71, 7
See application file for complete search history.

(56) References Cited

U.S. PATENT DOCUMENTS

| | | | | |
|---|---|---|---|---|
| 4,041,721 | A * | 8/1977 | Kniel | 62/53.2 |
| 4,315,533 | A * | 2/1982 | Eagles | 141/387 |
| 4,494,475 | A * | 1/1985 | Eriksen | 114/230.14 |
| 4,735,167 | A * | 4/1988 | White et al. | 114/230.14 |
| 5,025,860 | A * | 6/1991 | Mandrin | 166/267 |
| 6,250,244 | B1 * | 6/2001 | Dubar et al. | 114/264 |
| 6,889,522 | B2 * | 5/2005 | Prible et al. | 62/611 |
| 8,100,076 | B1 * | 1/2012 | Shivers et al. | 114/230.14 |
| 8,104,416 | B1 * | 1/2012 | Shivers et al. | 114/230.14 |
| 8,104,417 | B1 * | 1/2012 | Shivers et al. | 114/230.14 |
| 8,186,170 | B2 * | 5/2012 | Boatman et al. | 62/50.2 |

* cited by examiner

*Primary Examiner* — Ajay Vasudeva
(74) *Attorney, Agent, or Firm* — Buskop Law Group, PC; Wendy Buskop

(57) ABSTRACT

A floating liquefaction vessel and connecting device system for receiving a dry gas, forming a liquefied natural gas, and offloading the liquefied natural gas, wherein the system can include a floating liquefaction vessel for receiving the dry gas, cooling the dry gas to form liquefied natural gas, flowing the liquefied natural to a transport vessel, and receiving a hydrocarbon vapor from the transport vessel. A floating liquefaction vessel controller can monitor offloading of the liquefied natural gas. A connecting device can connect the transport vessel to the floating liquefaction vessel. The connecting device can include an inner walkway telescopically contained within an outer walkway and configured to extend and retract from the outer walkway in response to motions.

20 Claims, 12 Drawing Sheets

FIGURE 9B

9A

ENCLOSING THE ENCLOSED WALKWAY USING PERFORATED OR NON-PERFORATED WALLS ON A FIRST SIDE, A SECOND SIDE, A TOP, AND A BOTTOM — 872

TRANSFERRING PERSONNEL AND EQUIPMENT WITHIN THE ENCLOSED WALKWAY FORMED IN THE TELESCOPING WALKWAY BETWEEN THE FLOATING LIQUEFACTION VESSEL AND THE TRANSPORT VESSEL — 874

RETURNING HYDROCARBON VAPOR FROM THE TRANSPORT VESSEL TO THE FLOATING LIQUEFACTION VESSEL USING A WALKWAY VAPOR RETURN FLEXIBLE CONDUIT CONNECTED TO THE TELESCOPING WALKWAY AND IN COMMUNICATION WITH A VAPOR RETURN FLEXIBLE CONDUIT ON THE FLOATING LIQUEFACTION VESSEL — 876

MAINTAINING THE HYDROCARBON VAPOR AT A CRYOGENIC TEMPERATURE — 878

USING THE HYDROCARBON VAPOR TO POWER THE TRANSPORT VESSEL, THE FLOATING LIQUEFACTION VESSEL, THE CONNECTING DEVICE, OR COMBINATIONS THEREOF — 880

USING A TRANSPORT VESSEL CONTROLLER OF THE TRANSPORT VESSEL TO CONTINUOUSLY MONITOR A MEMBER OF THE GROUP CONSISTING OF: RECEIPT OF THE LIQUEFIED NATURAL GAS, STORAGE OF THE LIQUEFIED NATURAL GAS IN THE STORAGE TANKS, OFFLOADING OF THE LIQUEFIED NATURAL GAS FROM THE STORAGE TANKS, AND COMBINATION THEREOF — 882

USING THE TRANSPORT VESSEL CONTROLLER TO MONITOR VARIOUS OFFLOADING AND OTHER DATA INCLUDING: LIQUEFIED NATURAL GAS LOADING RATE, VESSEL DRAFT, LIQUEFIED NATURAL GAS TEMPERATURE, CARGO TONNAGE, VESSEL TRIM, AND TRANSPORT VESSEL MOTIONS INCLUDING PITCH, YAW, ROLL, SURGE, SWAY, AND HEAVE — 884

USING THE TRANSPORT VESSEL CONTROLLER TO COMPARE REAL-TIME MONITORED DATA TO STORED DATA IN A DATA STORAGE AND INITIATE ALARMS WHEN LOADING RATES, PRESSURES, OR TEMPERATURES EXCEED OR FALL BELOW PREDEFINED LIMITS FOR A CERTAIN TRANSPORT VESSEL, A CERTAIN SET OF STORAGE TANKS, OR A CERTAIN WEATHER CONDITION — 886

DYNAMICALLY POSITIONING THE TRANSPORT VESSEL IN PROXIMITY TO THE FLOATING LIQUEFACTION VESSEL USING COMPUTER INSTRUCTIONS IN THE TRANSPORT VESSEL CONTROLLER AND A MEMBER OF THE GROUP CONSISTING OF: MOTIONS MEASURED BY A MOTION SENSOR ON THE CONNECTING DEVICE OR THE TRANSPORT VESSEL, A FAN BEAM ON THE CONNECTING DEVICE OR THE TRANSPORT VESSEL, A DYNAMIC GLOBAL POSITIONING SYSTEM ON THE TRANSPORT VESSEL, AND COMBINATIONS THEREOF — 888

STORING THE LIQUEFIED NATURAL GAS IN THE STORAGE TANKS ON THE FLOATING TRANSPORT VESSEL AT A CRYOGENIC TEMPERATURE — 890

9C

FLOATING LIQUEFACTION VESSEL

CROSS REFERENCE TO RELATED APPLICATIONS

The current application is a Continuation in Part and claims priority to and the benefit of U.S. patent application Ser. No. 13/025,459 filed on Feb. 11, 2011, entitled "LIQUIFIED NATURAL GAS PROCESSING AND TRANSPORT SYSTEM," now issued as U.S. Pat. No. 8,100,076 on Jan. 24, 2012; U.S. patent application Ser. No. 13/025,477 filed on Feb. 11, 2011, entitled "FLOATING NATURAL GAS PROCESSING STATION," now issued as U.S. Pat. No. 8,104,416 on Jan. 31, 2012; U.S. patent application Ser. No. 13/025,493 filed on Feb. 11, 2011, entitled "SOFT YOKE," now issued as U.S. Pat. No. 8,104,417 on Jan. 31, 2012; co-pending U.S. patent application Ser. No. 13/025,524 filed on Feb. 11, 2011, entitled "METHOD FOR OFFSHORE NATURAL GAS PROCESSING USING A FLOATING STATION, A SOFT YOKE, AND A TRANSPORT SHIP"; co-pending U.S. patent application Ser. No. 13/025,569 filed on Feb. 11, 2011, entitled "METHOD FOR PROCESSING AND MOVING LIQUIFIED NATURAL GAS USING A FLOATING STATION AND A SOFT YOKE"; and co-pending U.S. patent application Ser. No. 13/025,604 filed on Feb. 11, 2011, entitled "METHOD FOR OFFLOADING A FLUID THAT FORMS A HYDROCARBON VAPOR USING A SOFT YOKE". These references are hereby incorporated in their entirety.

FIELD

The present embodiments generally relate to a floating liquefaction vessel with a connecting device configured to connect to transport vessels and accommodate for motion of the transport vessel, motion of the floating liquefaction vessel, and environmental factors, such as waves, for use in offloading of liquefied natural gas and receiving return vapors.

BACKGROUND

A need exists for a floating liquefaction vessel configured to provide processing of natural gas, also called dry gas, into liquefied natural gas.

A need exists for a floating liquefaction vessel for offshore transfer of liquefied natural gas to a transport vessel.

A need exists for a floating liquefaction vessel that is safe, prevents spills into surrounding waters, and is versatile for various sizes of transport vessels with different bow configurations.

A need exists for a floating liquefaction vessel with a connecting device that can dynamically react in real-time to constantly adjust to environmental conditions, such as wind and waves, to maintain a stable distance between the floating liquefaction vessel and a transport vessel, while simultaneously allowing for the transfer of people, equipment, and materials in a gangway or enclosed walkway, and while transferring liquefied natural gas to the transport vessel.

A need exists for a floating liquefaction vessel to transfer hydrocarbon vapor formed during offloading of liquefied natural gas from the transport vessel back to the floating liquefaction vessel.

A need exists for a floating liquefaction vessel that can quickly stop the flow of fluid and detach from the transport vessel for safety in anticipation of a major storm, such as a hurricane or a 100 year storm.

The present embodiments meet these needs.

BRIEF DESCRIPTION OF THE DRAWINGS

The detailed description will be better understood in conjunction with the accompanying drawings as follows:

FIGS. 9A-9C depict an embodiment of a method of using the floating liquefaction vessel.

Figure 1A:
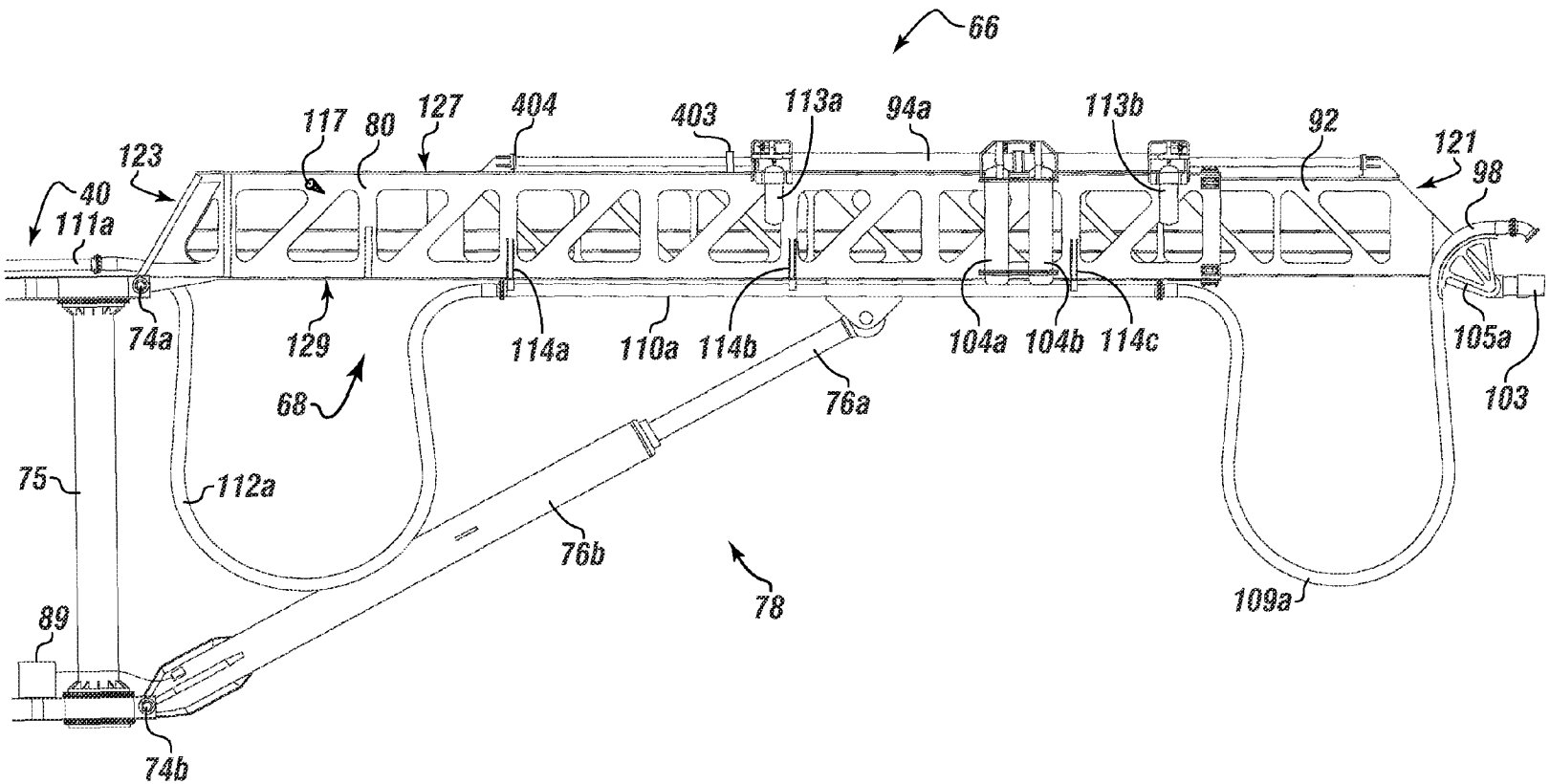
FIG. 1A depicts a first side view of a connecting device configured to connect the floating liquefaction vessel to a transport vessel and maintain the transport vessel spaced apart from the floating liquefaction vessel.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a floating liquefaction vessel for processing natural gas having a heat exchanger and a liquefaction train, for offloading the liquefied natural gas to a transport vessel, and for transporting the liquefied natural gas.

The floating liquefaction vessel can include a connecting device for connecting the floating liquefaction vessel to transport vessels.

The connecting device can function as a boarding structure attached to a portion of the floating liquefaction vessel with a pivot. The connecting device, along with a dynamic positioning system, can connect the transport vessel to the floating liquefaction vessel and maintain a safe distance therebetween.

A fan beam as used herein refers to a laser-based positioning system for dynamic positioning.

The connecting device can have an enclosed gangway or enclosed walkway for transferring personnel, material, and equipment between the floating liquefaction vessel and the transport vessel.

The connecting device can be mounted on the floating liquefaction vessel and configured to pivot from a vertical transport position to a horizontal deployed position to engage the transport vessel.

The connecting device can be made of steel, aluminum, a composite, or another structural material. The telescoping walkway can be perforated, allowing for wind to flow through the connecting device.

The connecting device can have a telescoping walkway, including an inner walkway slidably engaged within an outer walkway. The telescoping walkway can be configured to support from about 2.5 tons per foot to about 10 tons per foot.

The telescoping walkway can have a length ranging from about 50 feet to about 150 feet, and a width ranging from about 7 feet to about 14 feet. However, the size of the telescoping walkway can be different depending upon the particular application.

The telescoping walkway can have a connecting mount for engaging the floating liquefaction vessel. The connecting mount can be a rotational mount and can include a gear for rotating the telescoping walkway relative to the floating liquefaction vessel.

The connecting device can have a ram, which can be hydraulic or pneumatic. The ram can be connected to the floating liquefaction vessel with a second connecting mount, which can be a rotational mount and can include a gear for rotating the ram relative to the floating liquefaction vessel.

The ram can also be connected to the telescoping walkway and configured to extend to move the telescoping walkway upwards to a substantially vertical position relative to a sea level.

The ram can also be configured to retract to move the telescoping walkway downwards to a substantially horizontal position relative to the sea level for engagement with the transport vessel.

The telescoping walkway can have a pivoting structural anchoring point enabling the telescoping walkway to pivot upwards and away from a deck of the floating liquefaction vessel, and allowing each telescoping walkway to move to the transport position; thereby providing a safer floating liquefaction vessel that is less likely to turn over.

The inner walkway can be configured to extend outwards from the outer walkway, and retract inwards into the outer walkway.

The inner walkway can move relative to the outer walkway to account for wave motion, current motion, wind motion, transport vessel dynamics, floating liquefaction vessel dynamics, changes in draft, other motions, and other such variables; thereby preventing damage to the transport vessel, the floating liquefaction vessel, and the connecting device.

The inner walkway and the outer walkway can each be from about 7 feet to about 14 feet wide, and from about 50 feet to about 100 feet long.

The telescoping walkway can include an enclosed gangway or enclosed walkway with openings. The telescoping walkway can support movement of personnel and equipment of up to 800 pounds between the transport vessel and the floating liquefaction vessel.

The floating liquefaction vessel can have a floating liquefaction vessel hull with a deck and crew quarters.

The floating liquefaction vessel hull can be a three or more column type floating hull. The columns can be ballasted columns for use in water, such as water that is about 200 feet deep or deeper. The columns can be connected together. The floating liquefaction vessel hull can also be a semi-submersible hull or another type of hull.

The floating liquefaction vessel can be connected to or in fluid communication with a pretreatment source, which can be on another floating vessel, another platform, a floating or fixed platform, or the like.

The pretreatment source can supply a dry gas to the floating liquefaction vessel for processing thereon.

The pretreatment source can include a pretreatment dehydrator for removing water from natural gas to form the dry gas. For example, the pretreatment dehydrator can receive natural gas from a natural gas well, and can then remove water vapor before passing the dry gas to the floating liquefaction vessel.

The pretreatment source can include a pretreatment heat exchanger that can cryogenically cool the dry gas to a first cool temperature before transferring the dry gas to the floating liquefaction vessel. The cryogenically cooling of the dry gas can reduce the temperature of the dry gas by at least 300 percent.

In one or more embodiments, the pretreatment source can provide a continuous flow of the dry gas to the floating liquefaction vessel for processing into liquefied natural gas.

The dry gas can include primarily methane gas with small amounts of ethane, propane, butane, and less than 10 percent of heavier components. Approximately 65 percent of acid gas and water vapor can be removed from the natural gas when forming the dry gas at the pretreatment source.

The pretreatment source can have dynamic positioning equipment that can communicate with the floating liquefaction vessel for positioning of the pretreatment source.

The pretreatment source can have a bulk separator to remove liquid from the natural gas, an acid gas removal source to remove acid gas from the natural gas, a dehydrator to remove water vapor from the natural gas, a cryogenic plant to remove heavier hydrocarbons from the natural gas, or combinations thereof. The heavier hydrocarbons that can be removed by the cryogenic plant can include pentane, propane, and butane.

The dry gas from the pretreatment source can flow to the floating liquefaction vessel to a heat exchanger on the floating liquefaction vessel, such as through a dry gas inlet conduit.

The floating liquefaction vessel can have multiple heat exchangers, which can be used in series or parallel to cryogenically cool the dry gas. The heat exchanger and the pretreatment heat exchanger can each be a cold box, a spiral wound heat exchanger, or another type of heat exchanger.

The floating liquefaction vessel can be spread moored using from about eight to about twelve mooring lines. The mooring lines can be wire rope, chain and wire rope, or similar material used for mooring to anchors, such as suction pile anchors, in the seabed.

The mooring spread can be configured such that at least two mooring lines can break while the remaining mooring lines can continue to hold the floating liquefaction vessel in place, such as in the event of a hurricane or a 100 year storm.

The floating liquefaction vessel can have a turret that can be connected to the floating liquefaction vessel hull and to the mooring lines.

The dry gas inlet conduit from the pretreatment source can be configured to enter the floating liquefaction vessel through the turret, or the dry gas inlet conduit can pass directly to a deck of the floating liquefaction vessel without passing through the turret.

The heat exchanger can be in fluid communication with a liquefaction train or natural gas liquefaction train. The liquefaction train can be a dual expansion nitrogen cycle assembly, a single mixed refrigerant, a dual mixed refrigerant, a cascade refrigerant, or another natural gas liquefaction train. The liquefaction train can cool the dry gas within the heat exchanger, such that the heat exchanger can produce the liquefied natural gas from the dry gas.

The liquefied natural gas can flow from the floating liquefaction vessel heat exchanger, through offload flexible conduits on the floating liquefaction vessel, through walkway offload flexible conduits on the connecting device, and into storage tanks on transport vessels.

The offload flexible conduit and walkway offload flexible conduit can be used to continuously flow liquefied natural gas from the floating liquefaction vessel for offloading onto transport vessels.

The offload flexible conduit and walkway offload flexible conduit can each have a sensor that can be connected to a floating liquefaction vessel controller and/or the transport vessel controller to monitor temperature, pressure, and flow rates of the flowing liquefied natural gas.

The floating liquefaction vessel controller and/or a transport vessel controller on the transport vessel can monitor and control onboard processes including offloading processes. For example, the floating liquefaction vessel controller can monitor and control the dry gas inlet conduit, the heat exchanger, the offload flexible conduit, and a vapor return flexible conduit, for pressures, temperature, and flow rate.

The floating liquefaction vessel controller can control the dry gas inlet conduit, such as by controlling an emergency shut off device and initiating the emergency shut off device as required. For example, the emergency shut off device can be initiated if a pressure, temperature, or flow rate exceeds or falls below a preset limit.

The floating liquefaction vessel controller can monitor the heat exchanger by monitoring rates of temperature change, flow rates of pre-cooled gas, as well as temperature and flow rates of refrigerant used in the heat exchanger.

During offloading of the liquefied natural gas into the storage tanks, a hydrocarbon vapor can be formed. The hydrocarbon vapor can be transferred back to the heat exchanger on the floating liquefaction vessel. For example, the hydrocarbon vapor can flow through a walkway vapor return flexible conduit on the connecting device, through a vapor return flexible conduit on the floating liquefaction vessel, and into the heat exchanger for recycling.

The floating liquefaction vessel controller can monitor the vapor return flexible conduit and the walkway vapor return flexible conduit by monitoring the vapor return rates, vapor temperatures, and vapor pressures therein.

In operation, once the transport vessel is connected to the floating liquefaction vessel, the walkway flexible offload conduit can communicate with one or more storage tanks on the transport vessel, and the liquefied natural gas can be pumped from the floating liquefaction vessel to the storage tanks.

In one or more embodiments, the hydrocarbon vapor can be used as fuel for the floating liquefaction vessel, the transport vessel, the connecting device, or combinations thereof. For example, the transport vessel can be configured to use the hydrocarbon vapor as a fuel to power motors or turbines of the transport vessel.

The floating liquefaction vessel can be used to receive and process dry gas into liquefied natural gas.

The floating liquefaction vessel can be used with a variety of transport vessel.

One or more embodiments of the transport vessel can use a computer controlled dynamic positioning system in conjunction with propellers and thrusters to automatically maintain a position and heading of the transport vessel. For example, the transport vessel can have a transport vessel controller that can control the dynamic positioning.

The dynamic positioning equipment can include: position reference sensors, motion sensors, fan beams, a dynamic global positioning system, wind sensors, gyro compasses, or combinations thereof.

The dynamic positioning equipment can provide information to the transport vessel controller pertaining to the position of the transport vessel, magnitude and direction of environmental forces affecting the position, and other data.

Examples of vessel types that be used as the transport vessel can include vessels ships, semi-submersible Mobile Offshore Drilling Units (MODU), and oceanographic research vessels.

The transport vessel controller can contain a mathematical model of the transport vessel that includes information pertaining to the wind and current drag of the transport vessel and the location of the thrusters.

The mathematical model combined with the information from the position reference sensors, motion sensors, fan beams, a dynamic global positioning system, wind sensors, gyro compasses, or combinations thereof, can allow the transport vessel controller to calculate the required steering angle and thruster output for each thruster to maintain the transport vessel at a preset distance from the floating liquefaction vessel.

The dynamic positioning system of the transport vessel can allow operations at sea where mooring or anchoring is not feasible due to deep water, congestion on the sea bottom, or other problems.

The dynamic positioning system can be either absolute in that the position can be locked to a fixed point over the bottom, or relative to a moving object, such as another ship, the connecting device, the floating liquefaction vessel, or an underwater vehicle.

The transport vessel can be positioned at a favorable angle towards wind, waves, and current to weathervane.

The transport vessel can be a ship with a transport vessel hull, a transport vessel bow, a transport vessel stern, and a transport vessel variable draft.

The transport vessel, which can be a liquefied natural gas tanker, can have storage tanks built into the transport vessel hull for receiving the liquefied natural gas from the floating liquefaction vessel.

The storage tanks can be spherical, membrane, or prismatic type containment systems. For example, the transport vessel can have from one storage tank to about eight storage tanks. The storage tanks can be used to temporarily store the liquefied natural gas for transport.

The storage tanks can each be independent of each other on the transport vessel. One or more embodiments can include about five or six moss spherical tanks capable of storing a volume of about 125,000 cubic meters each, or membrane storage tanks configured to store a volume of about 135,000 cubic meters each. The membrane storage tanks can be maintained at ambient pressure.

After receipt of the liquefied natural gas, the storage tanks can be maintained at cryogenic temperatures and at a pressure up to about 2.5 bar, and the transport vessel can be used to transfer the liquefied natural gas to another location.

The floating liquefaction vessel can be used to quickly cease flow of fluids to the transport vessel for safety in anticipation of a major storm, such as a hurricane or a 100 year storm.

The transport vessel can be used to monitor and control of the offloading of the liquefied natural gas, as well as to monitor and control a flow of hydrocarbon vapor creating during offloading of the liquefied natural gas from the floating liquefaction vessel to the transport vessel.

For example, the transport vessel controller, which can be a computer system, can be connected to various transducers or sensors for monitoring the receipt, storage, and offloading of the liquefied natural gas.

The transport vessel controller can have a vessel processor. The transport vessel controller can also be used to monitor various offloading and other data including: a liquefied natural gas loading rate, a transport vessel draft, a liquefied natural gas temperature, a cargo tonnage, a transport vessel trim, and transport vessel motions including pitch, yaw, roll, surge, sway, and heave.

The transport vessel controller can compare real-time monitored data to stored data in a vessel data storage in communication with the vessel processor.

In operation, the comparison of the real-time monitored data to the stored data can be used to initiate alarms when loading rates, pressures, temperatures, or other measured data exceed or fall below predefined limits for the transport vessel, for storage tanks on the transport vessel, or for certain weather conditions. For example, an alarm can be initiated when there is excessive pitch, yaw, roll, surge, sway, and heave, such as during a 20 knot gale.

The transport vessel controller can compare real-time monitored longitude and latitude data to preset distances from the floating liquefaction vessel using the dynamic positioning system. The transport vessel controller can be in communication with a floating liquefaction vessel controller, providing additional verification that the preset distance is maintained to prevent collision.

The transport vessel can have a propulsion system for moving the transport vessel, which can be any ship propulsion system known in the art, such as a steam turbine motor, slow speed direct drive diesel motor, or diesel electric motor.

The transport vessel can use azimuthing pods or jet engines for positioning. The transport vessel can be a barge with removable thrusters mounted to the barge.

The transport vessel can have a navigation system connected to the dynamic positioning system and motors for controlling the propulsion system and the like.

Maintaining a safe but workable distance between the transport vessel and the floating liquefaction vessel can permit the safe offloading of personnel, gear, liquefied natural gas, and the safe return of hydrocarbon vapor formed during offloading of the liquefied natural gas.

Figure 1B:
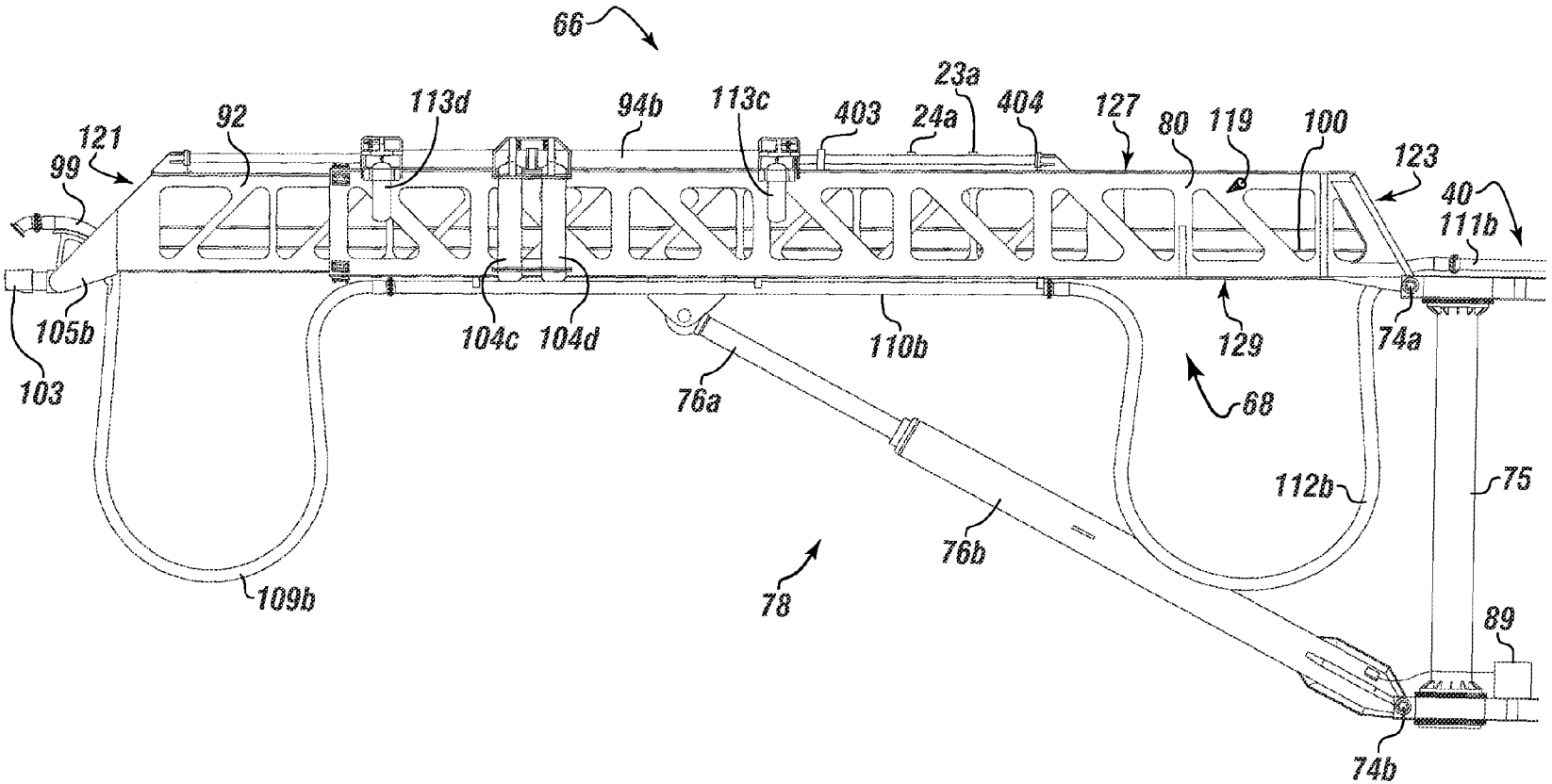
FIG. 1B depicts a second side view of the connecting device in a deployed position.

Turning now to the Figures, FIG. 1A depicts a side view of a connecting device 66 with a telescoping walkway 68, and FIG. 1B shows the opposite side of the connecting device 66 shown in FIG. 1A.

The connecting device 66 can be used for connecting transport vessels to a floating liquefaction vessel 40.

The connecting device 66 can include the telescoping walkway 68 connected to a ram 78.

A first connecting mount 74*a* can engage the telescoping walkway 68 with the floating liquefaction vessel 40, and a second connecting mount 74*b* can engage the ram 78 with the floating liquefaction vessel 40. For example, the connecting mounts 74*a* and 74*b* can connect to a post 75 of the floating liquefaction vessel 40.

The connecting mounts 74*a* and 74*b* can have diameters ranging from about 48 inches to about 84 inches, and can be made of powder coated steel. In one or more embodiments, the connecting mounts 74*a* and 74*b* can be pivotable, allowing the telescoping walkway 68 and the ram 78 to pivot about the connecting mounts 74*a* and 74*b*.

The connecting mounts 74*a* and 74*b* can be heel pins connected to the telescoping walkway 68 and the ram 78, allowing the telescoping walkway 68 and the ram 78 to rotate relative to the connecting mounts 74*a* and 74*b*. A heel pin can be machined from cold drawn high strength steel shafting, and can have a length from about 6 inches to about 18 inches and a diameter from about 6 inches to about 12 inches.

The telescoping walkway 68 and the ram 78 can be locked into the connecting mounts 74*a* and 74*b* using a collet and locking pin.

In one or more embodiments, the telescoping walkway 68 can be made from tubular steel, aluminum, hollow metal to reduce cost in shipping, or combinations thereof.

The telescoping walkway 68 can be configured to not fail upon impacts and slams, which can occur to the floating liquefaction vessel 40 to which the telescoping walkway 68 can be attached. For example, the telescoping walkway 68 can be configured to not fail upon impacts and slams during a 20 year storm, according the US Coast Guard classification of a 20 year storm, with wave sizes of up to twelve feet and a frequency ranging from about two feet to about three feet.

The telescoping walkway 68 can include an inner walkway 92 telescopically contained and slidably engaged within an outer walkway 80.

The inner walkway 92 can be configured to extend and retract from the outer walkway 80, such as when the floating liquefaction vessel 40 is connected to a transport vessel, and the telescoping walkway 68 is affected by wave motion, current motion, wind motion, transport vessel dynamics, floating liquefaction vessel dynamics, or combinations thereof.

In one or more embodiments, the inner walkway 92 can be controlled by hydraulic or pneumatic cylinders 94*a* and 94*b*.

The hydraulic or pneumatic cylinders 94*a* and 94*b* can control a position of the inner walkway 92 within the outer walkway 80, such as for extending and retracting the inner walkway 92 from the outer walkway 80 to initially connect the connecting device 66 with the floating liquefaction vessel 40. For example, the hydraulic or pneumatic cylinders 94*a* and 94*b* can be mounted in parallel on the opposite sides of the outer walkway 80 to extend and retract the inner walkway 92 within the outer walkway 80.

The hydraulic or pneumatic cylinders 94*a* and 94*b* can be connected to one or more accumulators 104*a*, 104*b*, 104*c*, and 104*d*. In one or more embodiments, any number of accumulators can be used.

The connecting device 66 can include one or more low pressure fluid accumulators 113*a*, 113*b*, 113*c*, and 113*d* for use with the hydraulic or pneumatic cylinders 94*a* and 94*b*. The one or more low pressure accumulators 113*a*, 113*b*, 113*c*, and 113*d* can each have a pressure from about 30 psi to about 300 psi.

One or more embodiments can include a stop 404 configured to selectively engage a hydraulic actuator switch 403. For example, the stop 404 can be located on the outer walkway 80, and the hydraulic actuator switch 403 can be located on the inner walkway 92. In operation, when the stop 404 engages the hydraulic actuator switch 403, the hydraulic actuator switch 403 can initiate release of the connecting device 66 from the transport vessel.

The connecting device 66 can include a walkway offload flexible conduit 98 for flowing liquefied natural gas from the floating liquefaction vessel 40 and a walkway vapor return flexible conduit 99 for flowing hydrocarbon vapor formed during offloading from the transport vessel back to the floating liquefaction vessel 40.

The walkway offload flexible conduit 98 can be in fluid communication with an offload flexible conduit on the floating liquefaction vessel 40, and the walkway vapor return flexible conduit 99 can be in fluid communication with a vapor return flexible conduit on the floating liquefaction vessel 40.

F For example, the walkway offload flexible conduit 98 can include a flexible portion 112*a* allowing the walkway offload flexible conduit 98 to move with the telescoping walkway 68. The flexible portion 112*a* can be connected to a walkway rigid portion 110*a*, providing a rigid connection between the walkway offload flexible conduit 98 and the outer walkway 80, and allowing the outer walkway 80 to securely move the walkway offload flexible conduit 98 as the telescoping walkway 68 moves.

The walkway offload flexible conduit 98 can also include a rigid portion 111*a* providing a rigid connection to the floating liquefaction vessel 40, and allowing the outer walkway 80 to securely move the walkway offload flexible conduit 98 as the telescoping walkway 68 moves.

The walkway offload flexible conduit 98 can also include a walkway flexible portion 109*a*, allowing the walkway offload flexible conduit 98 to move with the telescoping walkway 68.

Also, the walkway vapor return flexible conduit 99 can include a flexible portion 112*b* allowing the walkway vapor return flexible conduit 99 to move with the telescoping walkway 68.

The flexible portion 112*b* can be connected to a walkway rigid portion 110*b*, providing a rigid connection between the walkway vapor return flexible conduit 99 and the outer walkway 80, and allowing the outer walkway 80 to securely move the walkway vapor return flexible conduit 99 as the telescoping walkway 68 moves.

The walkway vapor return flexible conduit 99 can also include a rigid portion 111*b* providing a rigid connection to the floating liquefaction vessel 40, and allowing the outer walkway 80 to securely move the walkway vapor return flexible conduit 99 as the telescoping walkway 68 moves.

The walkway vapor return flexible conduit 99 can also include a walkway flexible portion 109*b*, allowing the walkway vapor return flexible conduit 99 to move with the telescoping walkway 68.

In operation, the walkway offload flexible conduit 98 can flow the liquefied natural gas from the floating liquefaction vessel 40 into storage tanks on transport vessels. The transport vessels can receive, store, transport, and offload the liquefied natural gas. The walkway vapor return conduit 99 can flow hydrocarbon vapor formed during offloading of the liquefied natural gas back from the transport vessels to the floating liquefaction vessel 40. The hydrocarbon vapor can serve as a fuel supply for the floating liquefaction vessel 40 or the like.

The walkway offload flexible conduit 98 and the walkway vapor return conduit 99 can each be made from about eight inch to about ten inch diameter rigid pipe, flexible composite cryogenic hose, or combinations thereof. The walkway offload flexible conduit 98 and the walkway vapor return conduit 99 can be any size or material as required for the particular application, given particular flow rates, pressures, and storm conditions. For example, the walkway offload flexible conduit 98 and the walkway vapor return conduit 99 can be three inch or larger diameter reinforced hose, a draped hose, or a festooned hose.

The walkway offload flexible conduit 98 and the walkway vapor return flexible conduit 99 can be secured to the outer walkway 80, such as by gussets 105*a* and 105*b*, and support structures 114*a*, 114*b*, and 114*c*. Each support structure 114*a*, 114*b*, and 114*c* and gusset 105*a* and 105*b* can be pivotable and/or rotatable.

The connecting device 66 can include a connection interface 103 for connecting the connecting device 66 to the transport vessels or the like.

The ram 78 can include a ram first portion 76*a* and a ram second portion 76*b*. The ram 78 can be a hydraulic ram or a pneumatic ram.

The ram first portion 76*a* can slidably engage within the ram second portion 76*b*. The ram first portion 76*a* can be connected to the telescoping walkway 68.

The ram second portion 76*b* can be connected to the floating liquefaction vessel 40, such as to the post 75 below the connection of the telescoping walkway 68 to the floating liquefaction vessel 40. The ram second portion 76*b* can connect to the post 75 with the second connecting mount 74*b*.

A connecting device controller 89 can be in communication with a floating liquefaction vessel controller, which is shown in FIG. 3A, and the ram 78 for controlling the ram 78.

Since the outer walkway 80 can be raised and lowered using the ram 78, the walkway flexible portions 109*a* and 109*b* and the flexible portions 112*a* and 112*b* can enable the walkway offload flexible conduit 98 and the walkway vapor return conduit 99 to have enough range of motion and flexibility to move with the outer walkway 80 without fracturing or being over tensioned.

In one or more embodiments, the connecting device 66 can have a length ranging from about 40 feet to about 140 feet, a height ranging from about 8 feet to about 14 feet, and a width ranging from about 8 feet to about 16 feet.

The connecting device 66 can be configured to accommodate for environmental factors that can shift a position of the transport vessel, the floating liquefaction vessel 40, the connecting device 66, or combinations thereof, to allow for continuous loading of liquefied natural gas, and allow for safe transfer of people and equipment over a gangway or enclosed walkway formed by the connecting device 66.

The connecting device 66 can provide for higher levels of safety by maintaining safe distances using computer controlled devices between the transport vessel and the floating liquefaction vessel 40. The environmental factors can include wave motions, current motions, wind, transport vessel dynamics or the like, floating liquefaction vessel dynamics or the like, changes in draft, and other such external and internal variables.

The connecting device 66 can prevent disconnection of any conduits communicating between the floating liquefaction vessel 40 and the transport vessel or the like, by maintaining the correct spacing therebetween, such as at a predefined or preset distance.

Predefined or preset distances from the floating liquefaction vessel 40 can be any distance required for the particular application, and can be controlled by dynamic positioning equipment on the transport vessel. For example, a nominal standoff position can range from about ninety feet to about one hundred ten feet.

The inner walkway 92 and outer walkway 80 can also be configured for moving personnel and equipment between the transport vessel and the floating liquefaction vessel, such as through an enclosed portion of the inner walkway 92 and the outer walkway 80, or through an enclosed walkway 100, which can be an enclosed gangway.

The inner walkway 92, outer walkway 80, enclosed walkway 100, or combinations thereof can be enclosed using walls on a first side 117, a second side 119, a top 127, and a bottom 129.

The inner walkway 92 can have a front 121, and the outer walkway 80 can have a back 123. In one or more embodiments, the walls can be perforated walls.

The connecting device 66 can have a motion sensor 23*a* and a fan beam 24*a* configured to measure a position of the connecting device 66. The motion sensor 23*a* and fan beam 24*a* can be in communication with a transport vessel controller to allow the transport vessel to adjust position based upon the measured position of the connecting device 66.

Figure 1C:
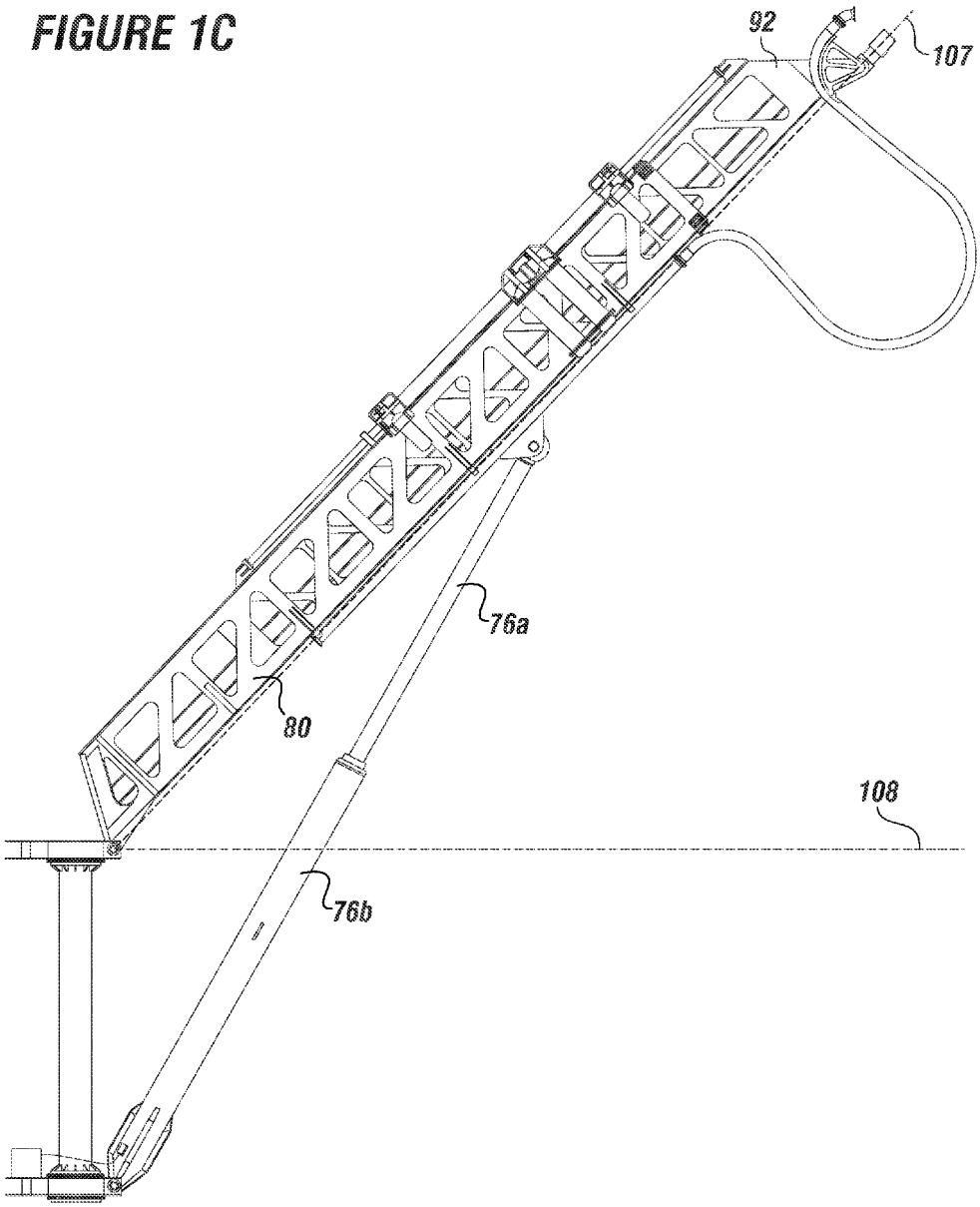
FIG. 1C shows a side view of the connecting device in a transport position.

FIG. 1C depicts the outer walkway 80 and the inner walkway 92 in a transport position 107.

In operation, the ram first portion 76*a* and the ram second portion 76*b* can hold the outer walkway 80 and the inner walkway 92 in the transport position 107, such as during transport of the floating liquefaction vessel.

In operation, the outer walkway 80 and the inner walkway 92 can be lowered to the deployed position 108.

For example, the connecting device controller, as shown in FIGS. 1A and 1B, can initiate extension of the ram first portion 76*a* from the ram second portion 76*b* to move the outer walkway 80 and the inner walkway 92 into the transport position 107. Also, the connecting device controller can initiate retraction of the ram first portion 76*a* into the ram second portion 76*b* to move outer walkway 80 and the inner walkway 92 into the deployed position 108.

Therefore, the outer walkway 80 and the inner walkway 92 can be designed to pivot from the transport position 107 at least partially perpendicular to a sea level, to the deployed position 108 substantially parallel with the sea level.

Figure 2:
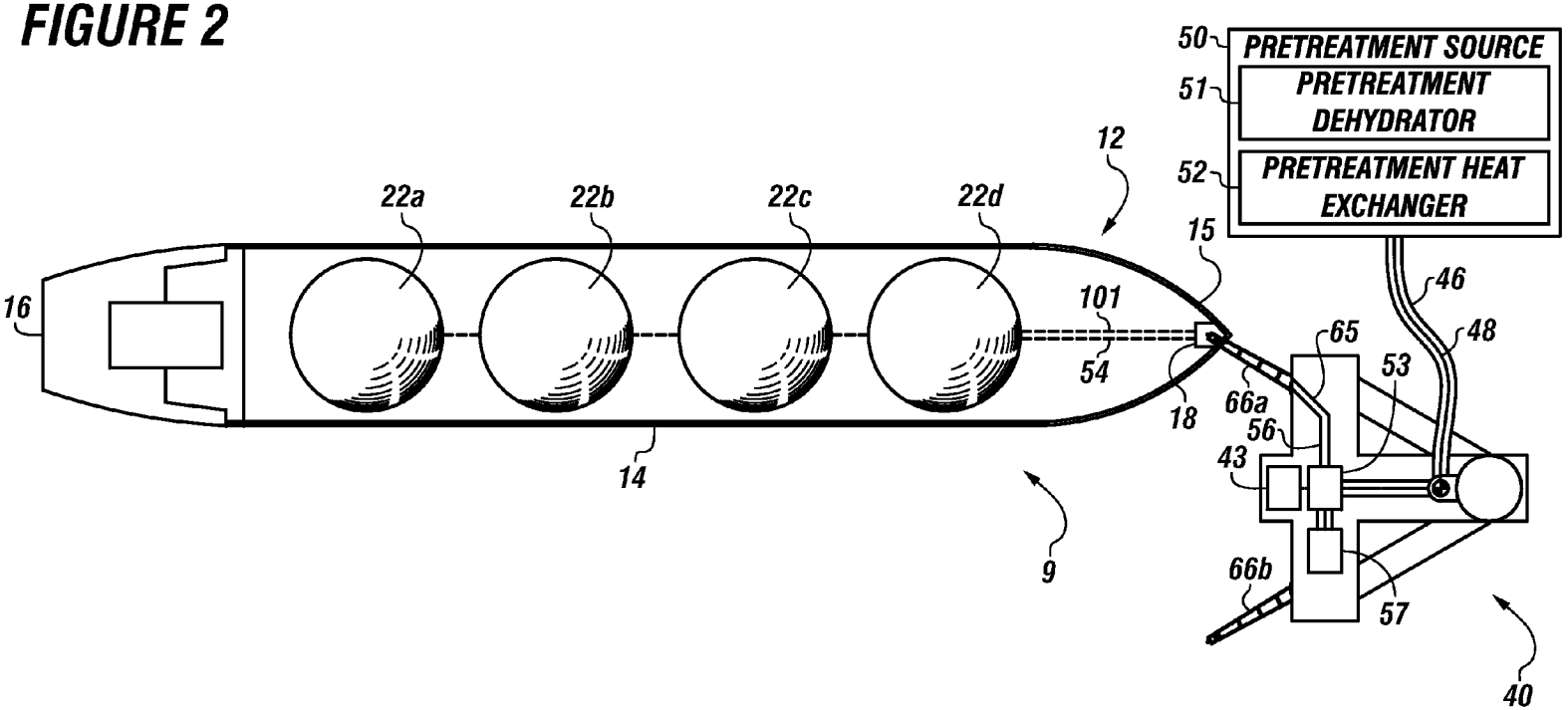
FIG. 2 depicts a top view of a first connecting devices connecting between the floating liquefaction vessel and the transport vessel, and a spare second connecting device.

FIG. 2 depicts a top view of a floating liquefaction vessel 40 and transport system 9 for receiving, storing, and transporting a liquefied natural gas 54.

A first connecting device 66*a* can connect the floating liquefaction vessel 40 to a transport vessel 12. The first connecting device 66*a* can engage a transport vessel bow 15 of the transport vessel 12. For example, the first connecting device 66*a* can engage a mooring socket 18 on the transport vessel 12.

A second connecting device 66*b* can be on the floating liquefaction vessel 40 as a spare or back-up for use when the first connecting device 66*a* is out of service.

The transport vessel 12 can have a transport vessel hull 14 between the transport vessel bow 15 and a transport vessel stern 16.

The floating liquefaction vessel 40 is depicted as a semisubmersible structure.

The floating liquefaction vessel 40 can have a heat exchanger 53 in fluid communication with a pretreatment source 50 for receiving a dry gas 48 from the pretreatment source 50 through a dry gas inlet conduit 46.

The pretreatment source 50 can have a pretreatment dehydrator 51 and a pretreatment heat exchanger 52. Accordingly, the pretreatment source 50 can be configured to cool and dry natural gas from a wellbore or other source to form the dry gas 48.

The dry gas 48 can flow from the pretreatment source 50, through the dry gas inlet conduit 46, and into the heat exchanger 53.

A liquefaction train 57 can cool the dry gas 48 within the heat exchanger 53 to form the liquefied natural gas 54.

The heat exchanger 53 and the pretreatment heat exchanger 52 can each be a cold box or a spiral wound heat exchanger for cryogenic cooling of the dry gas 48.

The liquefied natural gas 54 can flow from floating liquefaction vessel 40 through an offload flexible conduit 56, through a walkway offload flexible conduit on the first connecting device 66*a*, which is shown in FIG. 1A, and into storage tanks 22*a*, 22*b*, 22*c*, and 22*d* on the transport vessel 12.

The transport vessel 12 can receive the liquefied natural gas 54, temporarily store the liquefied natural gas 54, and transport the liquefied natural gas 54 to another location.

A hydrocarbon vapor 101 can be formed during offloading of the liquefied natural gas 54 onto the transport vessel 12. The hydrocarbon vapor 101 can flow from the transport vessel 12, through the walkway vapor return flexible conduits on the first connecting device 66*a*, as shown in FIG. 1B, through a vapor return flexible conduit 65, and to the heat exchanger 53 for recycling or use as a fuel.

The floating liquefaction vessel 40 can have a floating liquefaction vessel controller 43 to control one or more components thereof, including the heat exchanger 53, the liquefaction train 57, the dry gas inlet conduit 46, the offload flexible conduit 56, and the vapor return flexible conduit 65.

Figure 3:
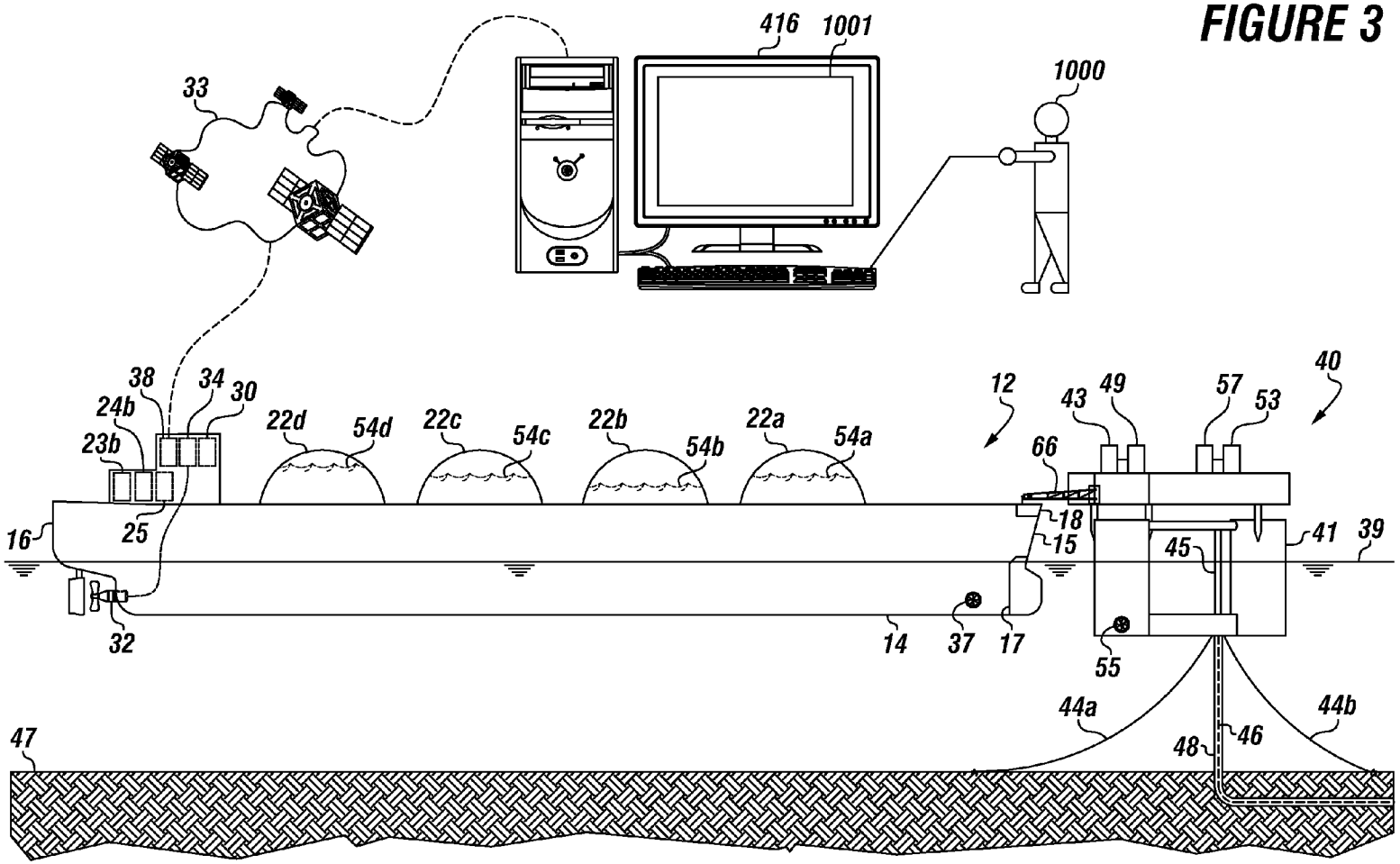
FIG. 3 depicts a side view of a connecting device connecting between the transport vessel and the floating liquefaction vessel along with a remote user in communication with a network.

FIG. 3 depicts a side view of the floating liquefaction vessel.

The floating liquefaction vessel 40 can have the connecting device 66 engaged with the mooring socket 18 of the transport vessel 12 at the transport vessel bow 15.

The floating liquefaction vessel 40 can have a turret 45 moored to a seabed 47 with a plurality of mooring lines 44*a* and 44*b*. The plurality of mooring lines 44*a* and 44*b* can connect through the turret 45, allowing the floating liquefaction vessel 40 to weather vane according to weather conditions, wind direction, and wave direction.

For example, the turret 45 can allow the floating liquefaction vessel 40 to pivot and/or rotate about the turret 45, while the turret 45 can be fixed by the plurality of mooring lines 44*a* and 44*b*.

In one or more embodiments, the plurality of mooring lines 44*a* and 44*b* can be configured to allow the floating liquefaction vessel 40 to be spread moored.

The dry gas inlet conduit 46 can extend into the turret 45 for communicating the dry gas 48 from a pretreatment source for processing on the floating liquefaction vessel 40 with the liquefaction train 57 and the heat exchanger 53.

The floating liquefaction vessel 40 can be a ballasted floating vessel with a floating liquefaction vessel hull 41 and a floating liquefaction vessel variable draft. The floating liquefaction vessel hull 41 can be at least a three column connected hull.

In one or more embodiments, the floating liquefaction vessel 40 can use heading controls 49 connected to thrusters 55 to position the floating liquefaction vessel 40. The floating liquefaction vessel controller 43 can be connected to the heading controls 49 and the thrusters 55.

The transport vessel bow 15 can connect directly to the outer walkway of the connecting device 66. Pivots can be employed with the connecting device 66 to rotate the connecting device 66, allowing the liquefied natural gas 54*a*, 54*b*, 54*c*, and 54*d* to flow into the storage tanks 22*a*, 22*b*, 22*c* and 22*d* from the heat exchanger 53.

The transport vessel hull 14 can have a variable draft 17, allowing the transport vessel 12 to change draft and balance with respect to a sea level 39 to be capable of receiving and offloading the liquefied natural gas 54*a*, 54*b*, 54*c*, and 54*d*. The transport vessel 12 can also have the transport vessel stern 16.

The transport vessel 12 can include a transport vessel controller 30 with a vessel processor and vessel data storage for monitoring data associated with the receipt of the liquefied natural gas 54*a*, 54*b*, 54*c*, and 54*d*, the storage of the liquefied natural gas 54*a*, 54*b*, 54*c*, and 54*d*, and the offloading the liquefied natural gas 54*a*, 54*b*, 54*c*, and 54*d* from the transport vessel 12.

The transport vessel 12 can include a propulsion system 32 for moving the transport vessel 12 and a navigation system 34 for controlling the propulsion system 32.

The transport vessel 12 can have a station keeping device 38 that operates dynamic positioning thrusters 37 as part of the dynamic positioning equipment of the transport vessel 12.

The transport vessel 12 can also have a motion sensor 23*b*, a fan beam 24*b*, and a dynamic global positioning system 25. The motion sensor 23*b*, fan beam 24*b*, and dynamic global positioning system 25 can measure a position of the transport vessel 12.

The motion sensor 23*b*, fan beam 24*b*, dynamic global positioning system 25, station keeping device 38, and navigation system 34 can each be in communication with a network 33, shown here as a satellite network, for dynamic positioning of the transport vessel 12.

A client device 416 with computer instructions can communicate with the network 33, allowing a remote user 1000 to monitor the processing, storage, and offloading of the liquefied natural gas 54*a*, 54*b*, 54*c*, and 54*d*.

The client device 416 can present an executive dashboard 1001 of data related to the processing, storage, and offloading of the liquefied natural gas 54*a*, 54*b*, 54*c*, and 54*d*.

Figure 4:
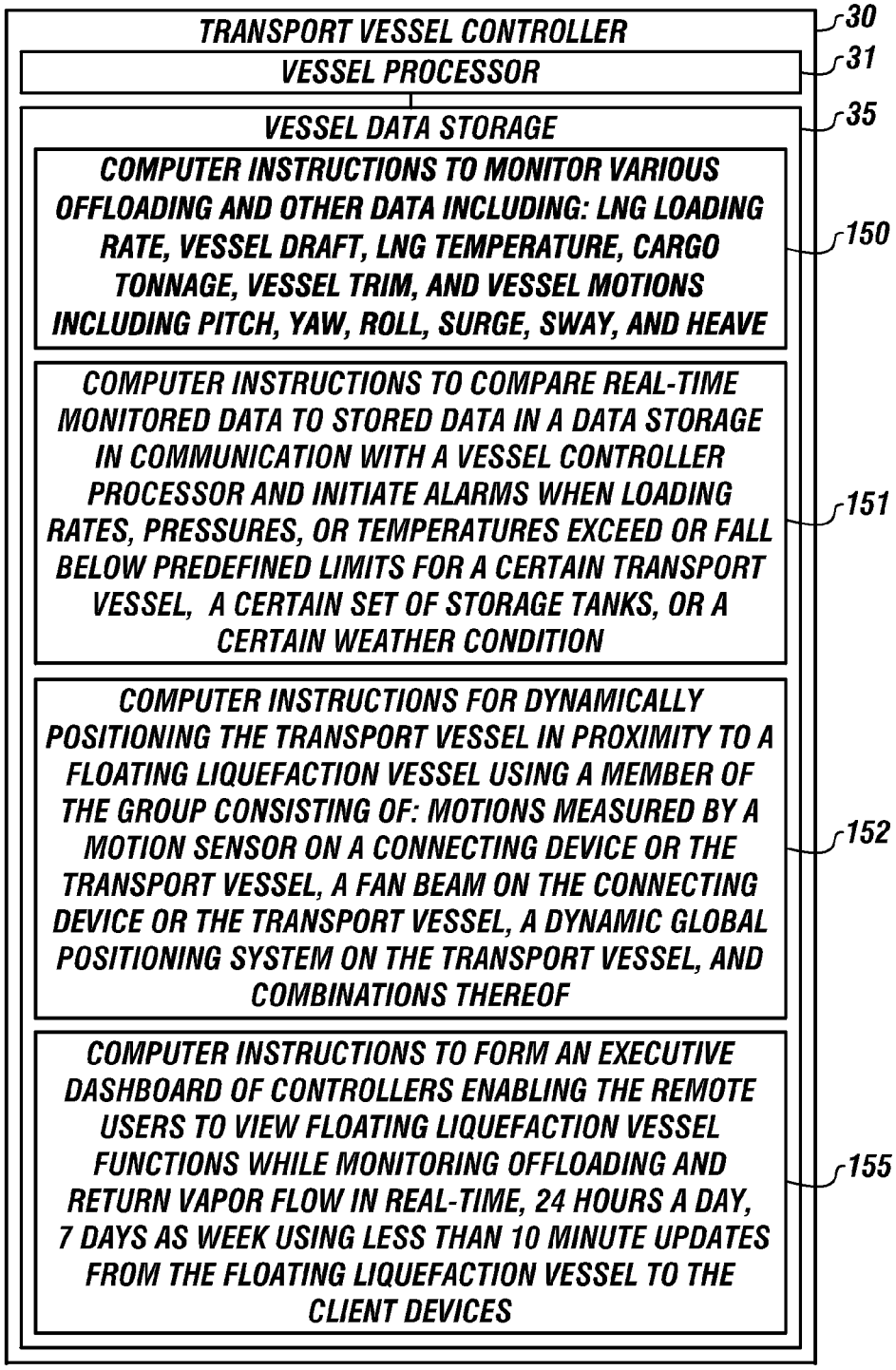
FIG. 4 depicts an embodiment of a transport vessel controller.

FIG. 4 depicts an embodiment of a floating vessel controller 30 with a vessel processor 31 and a vessel data storage 35.

The transport vessel controller 30 can monitor: receipt of the liquefied natural gas, storage of the liquefied natural gas in the storage tanks, and offloading of the liquefied natural gas from the storage tanks.

The vessel data storage 35 can have computer instructions to monitor various offloading and other data including: LNG loading rate, vessel draft, LNG temperature, cargo tonnage, vessel trim, and vessel motions including pitch, yaw, roll, surge, sway, and heave 150.

The vessel data storage 35 can have computer instructions to compare real-time monitored data to stored data in a data storage in communication with a vessel controller processor and initiate alarms when loading rates, pressures, or temperatures exceed or fall below predefined limits for a certain transport vessel, a certain set of storage tanks, or a certain weather condition 151.

The vessel data storage 35 can have computer instructions for dynamically positioning the transport vessel in proximity to a floating liquefaction vessel using a member of the group consisting of: motions measured by a motion sensor on a connecting device or the transport vessel, a fan beam on the connecting device or the transport vessel, a dynamic global positioning system on the transport vessel, and combinations thereof 152.

The vessel data storage 35 can have computer instructions to form an executive dashboard of controllers enabling the remote users to view floating liquefaction vessel functions while monitoring offloading and return vapor flow in real-time, 24 hours a day, 7 days as week using less than 10 minute updates from the floating liquefaction vessel to the client devices 155.

Figure 5:
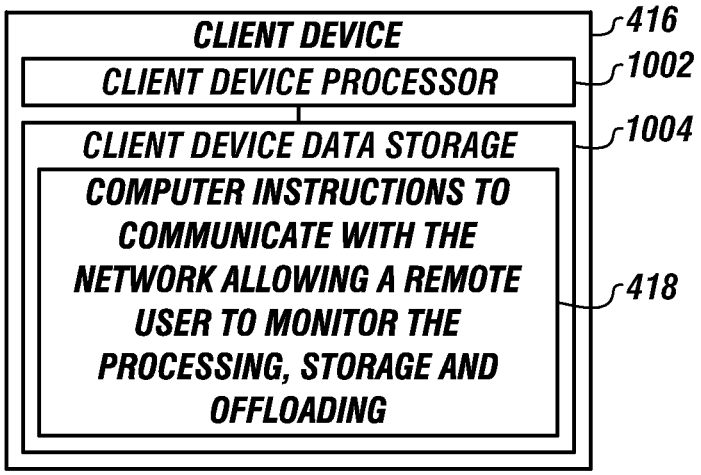
FIG. 5 depicts an embodiment of a client device.

FIG. 5 depicts an embodiment of the client device 416 with a client device processor 1002 and a client device data storage 1004. The client data storage 1004 can have computer instructions to communicate with the network allowing a remote user to monitor the processing, storage and offloading 418.

Figure 6:
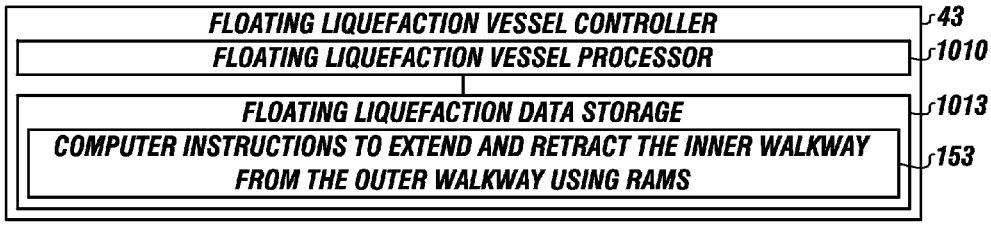
FIG. 6 depicts an embodiment of a floating liquefaction controller.

FIG. 6 depicts an embodiment of the floating liquefaction vessel controller 43 having a floating liquefaction vessel processor 1010 and floating liquefaction vessel data storage 1013.

The floating liquefaction vessel data storage 1013 can have computer instructions to extend and retract the inner walkway from the outer walkway using rams 153.

Figure 7:
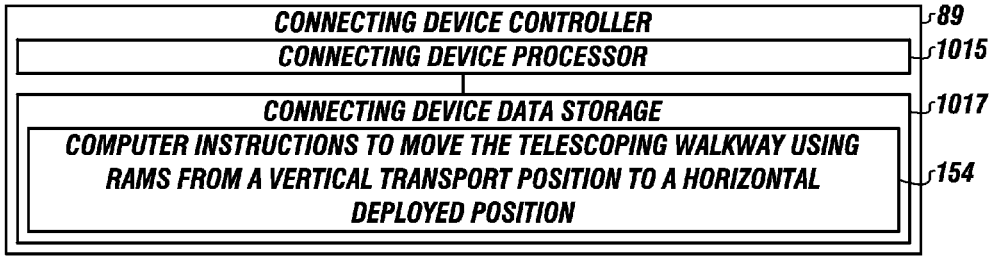
FIG. 7 depicts an embodiment a connecting device controller.

FIG. 7 depict an embodiment of the connecting device controller 89 having a connecting device processor 1015 and a connecting device data storage 1017.

The connecting device data storage 1017 can have computer instructions to move the telescoping walkway using rams from a vertical transport position to a horizontal deployed position 154.

Figure 8:
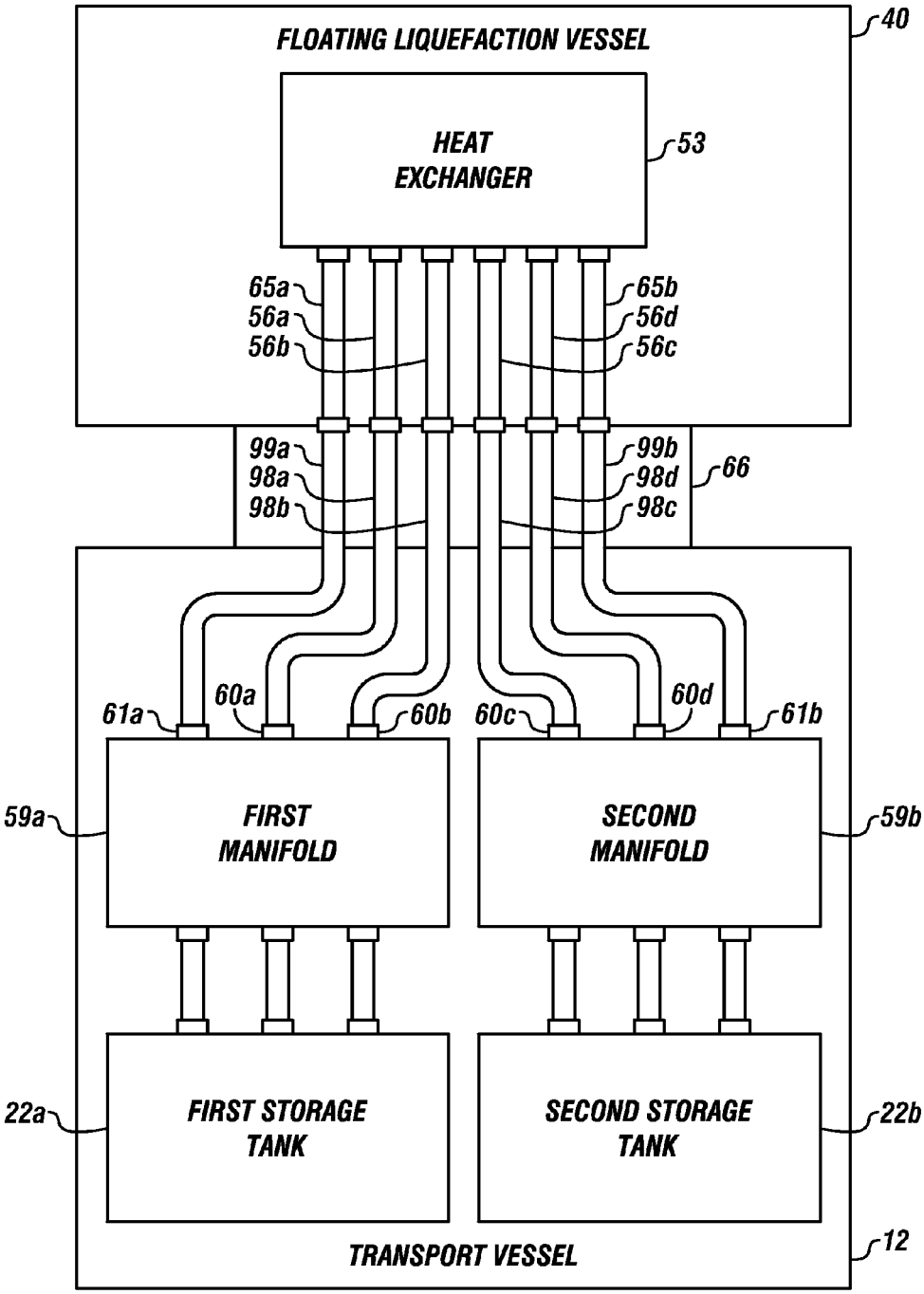
FIG. 8 depicts an embodiment of a transport vessel having manifolds.

FIG. 8 depicts an embodiment of the transport vessel 12 having a first manifold 59*a* and a second manifold 59*b*.

The floating liquefaction vessel 40 can have a first offload flexible conduit 56*a* and a second offload flexible outlet conduit 56*b* for flowing the liquefied natural gas from the heat exchanger 53, through a first walkway offload flexible conduit 98*a* and a second walkway offload flexible conduit 98*b* across the connecting device 66, to the transport vessel 12.

The liquefied natural gas can flow through the first walkway offload flexible conduit 98*a* and second walkway offload flexible conduit 98*b* into a first manifold inlet 60*a* and a second manifold inlet 60*b* of the first manifold 59*a*.

The liquefied natural gas can flow through the first manifold 59*a* into a first storage tank 22*a*.

The first manifold 59*a* can have a first manifold outlet 61*a* in fluid communication with the first storage tank 22*a* and with the first walkway vapor return flexible conduit 99*a* for flowing the hydrocarbon vapor to the floating liquefaction vessel 40.

The floating liquefaction vessel 40 can have a first vapor return flexible conduit 65*a* in fluid communication with the first walkway vapor return flexible conduit 99*a* for receiving the hydrocarbon vapor.

The floating liquefaction vessel 40 can have a third offload flexible conduit 56*c* and a fourth offload flexible outlet conduit 56*d* for flowing the liquefied natural gas from the heat exchanger 53, through a third walkway offload flexible conduit 98*c* and a fourth walkway offload flexible conduit 98*d* across the connecting device 66, to the transport vessel 12.

The liquefied natural gas can flow through the third walkway offload flexible conduit 98*c* and fourth walkway offload flexible conduit 98*d* into a third manifold inlet 60*c* and a fourth manifold inlet 60*d* of the second manifold 59*b*.

The liquefied natural gas can flow through the second manifold 59*b* into a second storage tank 22*b*.

The second manifold 59*b* can have a second manifold outlet 61*b* in fluid communication with the second storage tank 22*b* and with the second walkway vapor return flexible conduit 99*b* for flowing the hydrocarbon vapor to the floating liquefaction vessel 40.

The floating liquefaction vessel 40 can have a second vapor return flexible conduit 65*b* in fluid communication with the second walkway vapor return flexible conduit 99*b* for receiving the hydrocarbon vapor.

Figure 9A:
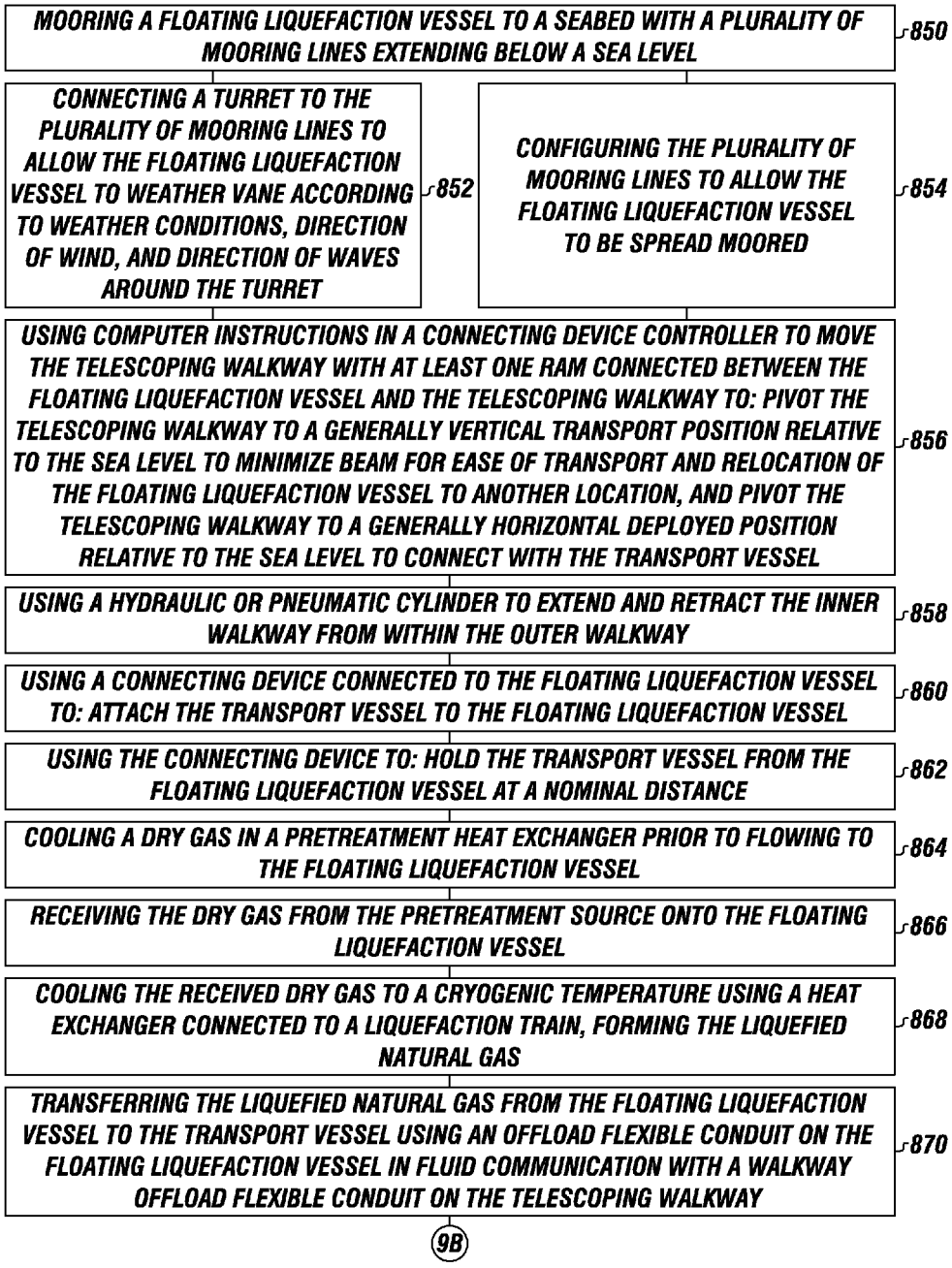
Figure 9C:
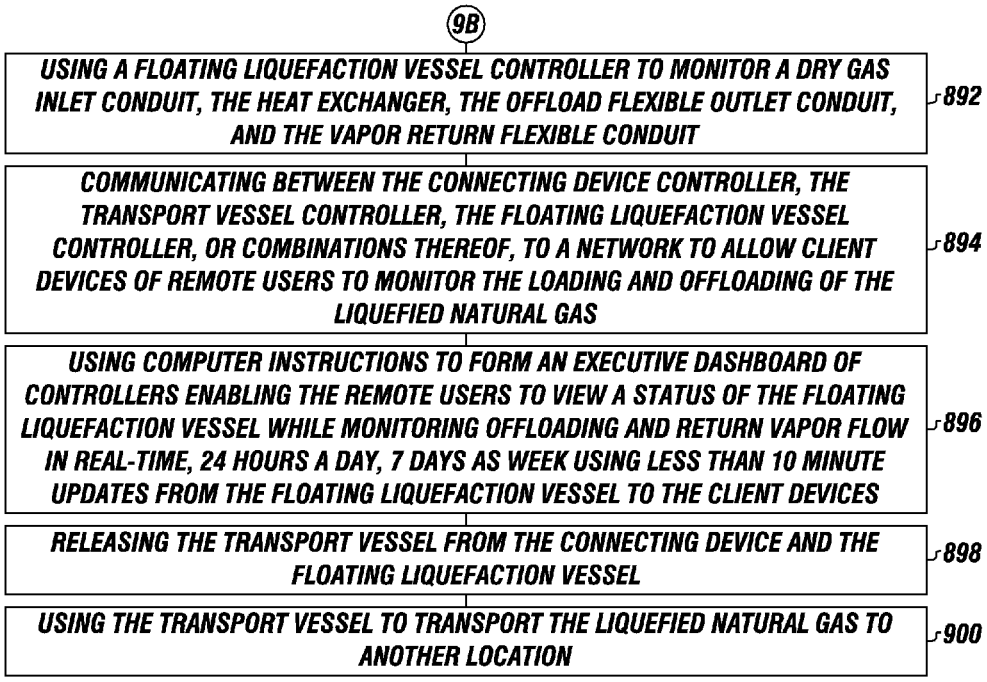

FIGS. 9A-9C depict an embodiment of a method for receiving a dry gas from a pretreatment source, processing the dry gas into a liquefied natural gas, offloading the liquefied natural gas to a transport vessel with storage tanks, and transporting the liquefied natural gas to another location using the transport vessel.

The method can include mooring a floating liquefaction vessel to a seabed with a plurality of mooring lines extending below a sea level, as illustrated by box 850.

The method can include connecting a turret to the plurality of mooring lines to allow the floating liquefaction vessel to weather vane according to weather conditions, direction of wind, and direction of waves around the turret, as illustrated by box 852, or configuring the plurality of mooring lines to allow the floating liquefaction vessel to be spread moored, as illustrated by box 854.

The method can include using computer instructions in a connecting device controller to move the telescoping walkway with at least one ram connected between the floating liquefaction vessel and the telescoping walkway to: pivot the telescoping walkway to a generally vertical transport position relative to the sea level to minimize beam for ease of transport and relocation of the floating liquefaction vessel to another location, and pivot the telescoping walkway to a generally horizontal deployed position relative to the sea level to connect with the transport vessel, as illustrated by box 856.

The method can include using a hydraulic or pneumatic cylinder to extend and retract the inner walkway from within the outer walkway, as illustrated by box 858.

The method can include using a connecting device connected to the floating liquefaction vessel to: attach the transport vessel to the floating liquefaction vessel, as illustrated by box 860.

The connecting device can have a telescoping walkway comprising an inner walkway slidably engaged within an outer walkway.

The method can include using the connecting device to: hold the transport vessel from the floating liquefaction vessel at a nominal distance, as illustrated by box 862.

The inner walkway can extend and retract from the outer walkway to accommodate wave action, wind effects, vessel dynamics, pitch, yaw, roll, surge, sway, and heave producing forces on the transport vessel and the floating liquefaction vessel.

The method can include cooling a dry gas in a pretreatment heat exchanger prior to flowing to the floating liquefaction vessel, as illustrated by box 864.

The cooling of the dry gas can be performed using a cold box or spiral wound heat exchanger, and the cooled dry gas can be processed into the liquefied natural gas using a dual expansion nitrogen cycle liquefaction train, a single mixed refrigerant liquefaction train, a dual mixed refrigerant liquefaction train, or combinations thereof.

The method can include receiving the dry gas from the pretreatment source onto the floating liquefaction vessel, as illustrated by box 866.

The dry gas can be methane with small amounts of ethane.

The method can include cooling the received dry gas to a cryogenic temperature using a heat exchanger connected to a liquefaction train, forming the liquefied natural gas, as illustrated by box 868.

The method can include transferring the liquefied natural gas from the floating liquefaction vessel to the transport vessel using an offload flexible conduit on the floating liquefaction vessel in fluid communication with a walkway offload flexible conduit on the telescoping walkway, as illustrated by box 870.

The method can include enclosing the enclosed walkway using perforated or non-perforated walls on a first side, a second side, a top, and a bottom, as illustrated by box 872.

The first side and the second side can each be connected between the top and the bottom.

The method can include transferring personnel and equipment within the enclosed walkway formed in the telescoping walkway between the floating liquefaction vessel and the transport vessel, as illustrated by box 874.

The method can include returning hydrocarbon vapor from the transport vessel to the floating liquefaction vessel using a walkway vapor return flexible conduit connected to the telescoping walkway and in communication with a vapor return flexible conduit on the floating liquefaction vessel, as illustrated by box 876.

The method can include maintaining the hydrocarbon vapor at a cryogenic temperature, as illustrated by box 878.

The hydrocarbon vapor can be formed during offloading of the liquefied natural gas from the floating liquefaction vessel to the transport vessel.

The method can include using the hydrocarbon vapor to power the transport vessel, the floating liquefaction vessel, the connecting device, or combinations thereof, as illustrated by box 880.

The method can include using a transport vessel controller of the transport vessel to continuously monitor a member of the group consisting of: receipt of the liquefied natural gas, storage of the liquefied natural gas in the storage tanks, offloading of the liquefied natural gas from the storage tanks, and combination thereof, as illustrated by box 882.

The method can include using the transport vessel controller to monitor various offloading and other data including: liquefied natural gas loading rate, vessel draft, liquefied natural gas temperature, cargo tonnage, vessel trim, and transport vessel motions including pitch, yaw, roll, surge, sway, and heave, as illustrated by box 884.

The method can include using the transport vessel controller to compare real-time monitored data to stored data in a data storage and initiate alarms when loading rates, pressures, or temperatures exceed or fall below predefined limits for a certain transport vessel, a certain set of storage tanks, or a certain weather condition, as illustrated by box 886.

The method can include dynamically positioning the transport vessel in proximity to the floating liquefaction vessel using computer instructions in the transport vessel controller and a member of the group consisting of: motions measured by a motion sensor on the connecting device or the transport vessel, a fan beam on the connecting device or the transport vessel, a dynamic global positioning system on the transport vessel, and combinations thereof, as illustrated by box 888.

The method can include storing the liquefied natural gas in the storage tanks on the floating transport vessel at a cryogenic temperature, as illustrated by box 890.

The method can include using a floating liquefaction vessel controller to monitor a dry gas inlet conduit, the heat exchanger, the offload flexible outlet conduit, and the vapor return flexible conduit, as illustrated by box 892.

The method can include communicating between the connecting device controller, the transport vessel controller, the floating liquefaction vessel controller, or combinations thereof, to a network to allow client devices of remote users to monitor the loading and offloading of the liquefied natural gas, as illustrated by box 894.

The method can include using computer instructions to form an executive dashboard of controllers enabling the remote users to view a status of the floating liquefaction vessel while monitoring offloading and return vapor flow in real-time, 24 hours a day, 7 days a week using less than 10 minute updates from the floating liquefaction vessel to the client devices, as illustrated by box 896.

The method can include releasing the transport vessel from the connecting device and the floating liquefaction vessel, as illustrated by box 898.

The method can include using the transport vessel to transport the liquefied natural gas to another location, as illustrated by box 900.

While these embodiments have been described with emphasis on the embodiments, it should be understood that within the scope of the appended claims, the embodiments might be practiced other than as specifically described herein.

What is claimed is:

1. A vessel for receiving a dry gas, forming a liquefied natural gas, and offloading the liquefied natural gas, the vessel comprising:

a. a floating liquefaction vessel comprising:
   (i) a floating liquefaction vessel hull;
   (ii) a plurality of mooring lines connecting the floating liquefaction vessel hull to a seabed;
   (iii) a dry gas inlet conduit for receiving the dry gas from a pretreatment source;
   (iv) a heat exchanger for cooling the dry gas from the dry gas inlet conduit;
   (v) a liquefaction train supported by the floating liquefaction vessel hull for cooling the dry gas in the heat exchanger, wherein the heat exchanger forms the liquefied natural gas;
   (vi) an offload flexible outlet conduit for flowing the liquefied natural gas from the heat exchanger to a transport vessel;
   (vii) a vapor return flexible conduit for communicating a hydrocarbon vapor formed during offloading from the transport vessel back to the floating liquefaction vessel, wherein the vapor return flexible conduit is in fluid communication with the heat exchanger; and
   (viii) a floating liquefaction vessel controller for monitoring the dry gas inlet conduit, the heat exchanger, the offload flexible outlet conduit, and the vapor return flexible conduit; and b. a connecting device for connecting the transport vessel to the floating liquefaction vessel, wherein the connecting device comprises:
   (i) a connecting mount engaging the connecting device with the floating liquefaction vessel;
   (ii) a telescoping walkway comprising an inner walkway telescopically contained within an outer walkway, wherein the inner walkway is configured to extend and retract from the outer walkway when the floating liquefaction vessel and the transport vessel are connected together and are affected by wave motion, current motion, wind motion, transport vessel dynamics, floating liquefaction vessel dynamics, or combinations thereof, and wherein the inner walkway and outer walkway are configured for moving personnel and equipment between the transport vessel and the floating liquefaction vessel;
   (iii) a walkway offload flexible conduit for flowing the liquefied natural gas from the floating liquefaction vessel; and
   (iv) a walkway vapor return flexible conduit for flowing the hydrocarbon vapor formed during offloading from the transport vessel back to the floating liquefaction vessel.

2. The vessel of claim 1, wherein the floating liquefaction vessel controller comprises computer instructions to extend and retract the inner walkway from the outer walkway using rams, wherein the rams are connected between the floating liquefaction vessel and the telescoping walkway, and wherein the rams are configured to move the telescoping walkway between a transport position and a deployed position.

3. The vessel of claim 1, further comprising a turret for connecting the plurality of mooring lines from the floating liquefaction vessel hull to the seabed allowing the floating liquefaction vessel to weather vane according to weather conditions, wind direction, and wave direction.

4. The vessel of claim 1, wherein the plurality of mooring lines are configured to allow the floating liquefaction vessel to be spread moored.

5. The vessel of claim 1, wherein the floating liquefaction vessel hull is a semisubmersible hull.

6. The vessel of claim 1, wherein the telescoping walkway is made of steel, aluminum, a non-deforming polymer composite, or combinations thereof.

7. The vessel of claim 1, wherein:

a. the offload flexible conduit and the vapor return flexible conduit each comprise:
   (i) a flexible portion allowing the offload flexible conduit and the vapor return flexible conduit to move with the telescoping walkway; and
   (ii) a rigid portion providing a rigid connection to the floating liquefaction vessel, allowing the outer walkway to securely move the offload flexible conduit and the vapor return flexible conduit as the telescoping walkway moves; and b. the walkway offload flexible conduit and the walkway vapor return flexible conduit each comprise:
   (i) a walkway flexible portion allowing the walkway offload flexible conduit and the walkway vapor return flexible conduit to move with the telescoping walkway; and
   (ii) a walkway rigid portion providing a rigid connection to the outer walkway, allowing the outer walkway to securely move the walkway offload flexible conduit and the walkway vapor return flexible conduit as the telescoping walkway moves.

8. The vessel of claim 1, wherein the floating liquefaction vessel hull is at least a three column connected hull.

9. The vessel of claim 1, wherein the dry gas is cooled in a pretreatment heat exchanger prior to flowing the dry gas to the floating liquefaction vessel.

10. The vessel of claim 9, wherein the heat exchanger and the pretreatment heat exchanger are each a cold box or a spiral wound heat exchanger for cryogenic cooling of the dry gas.

11. The vessel stem of claim 1, wherein the transport vessel controller further comprises computer instructions to monitor various offloading and other data including: LNG loading rate, vessel draft, LNG temperature, cargo tonnage, vessel trim, and vessel motions including pitch, yaw, roll, surge, sway, and heave.

12. The vessel of claim 11, wherein the transport vessel controller further comprises computer instructions to compare real-time monitored data to stored data in a data storage in communication with a vessel controller processor and initiate alarms when loading rates, pressures, or temperatures exceed or fall below predefined limits for a certain transport vessel, a certain set of storage tanks, or a certain weather condition.

13. The vessel of claim 1, further comprising a hydraulic or pneumatic cylinder configured to extend and retract the inner walkway from within the outer walkway.

14. The vessel of claim 1, further comprising a second offload flexible outlet conduit for flowing the liquefied natural gas from the heat exchanger.

15. The vessel of claim 14, further comprising a second walkway offload flexible outlet conduit in fluid communication with the second offload flexible outlet conduit for flowing the liquefied natural gas from the heat exchanger, across the connecting device, and to the transport vessel.

16. The vessel of claim 15, further comprising a manifold on the floating vessel, wherein the manifold comprises:

a. two manifold inlets in fluid communication with the walkway offload flexible outlet conduit and the second walkway offload flexible outlet conduit for receiving the liquefied natural gas and flowing the liquefied natural gas into the plurality of storage tanks; and b. a manifold outlet in fluid communication with the walkway vapor return flexible conduit for flowing the hydrocarbon vapor to the floating liquefaction vessel.

17. The vessel of claim 16, further comprising:

a. a third offload flexible outlet conduit and a fourth offload flexible outlet conduit for flowing the liquefied natural gas from the heat exchanger;

b. a third walkway offload flexible outlet conduit and a fourth walkway offload flexible outlet conduit in fluid communication with the third offload flexible outlet conduit and the fourth offload flexible outlet conduit for flowing the liquefied natural gas from the heat exchanger, across the connecting device, and to the transport vessel;

c. a second walkway vapor return flexible conduit; and d. a second manifold on the floating vessel, wherein the second manifold comprises:

(i) two second manifold inlets in fluid communication with the third walkway offload flexible outlet conduit and the fourth walkway offload flexible outlet conduit for receiving the liquefied natural gas and flowing the liquefied natural gas into the plurality of storage tanks; and (ii) a second manifold outlet in fluid communication with the second walkway vapor return flexible conduit for flowing the hydrocarbon vapor to the floating liquefaction vessel.

18. The vessel of claim 1, wherein the transport vessel further comprises a transport vessel controller for monitoring: receipt of the liquefied natural gas, storage of the liquefied natural gas in the storage tanks, and offloading of the liquefied natural gas from the storage tanks, wherein the transport vessel controller has computer instructions for dynamically positioning the transport vessel in proximity to the floating liquefaction vessel using a member of the group consisting of:

a. motions measured by a motion sensor on the connecting device or the transport vessel;

b. a fan beam laser-based positioning system on the connecting device or the transport vessel;

c. a dynamic global positioning system on the transport vessel; and d. combinations thereof.

19. A vessel for receiving a dry gas, forming a liquefied natural gas, and offloading the liquefied natural gas, the vessel comprising:

a. a floating liquefaction vessel comprising:

(i) a dry gas inlet conduit for receiving the dry gas from a pretreatment source;

(ii) a heat exchanger for cooling the dry gas from the dry gas inlet conduit;

(iii) a liquefaction train supported by the floating liquefaction vessel for cooling the dry gas in the heat exchanger, wherein the heat exchanger forms the liquefied natural gas;

(iv) an offload flexible outlet conduit for flowing the liquefied natural gas from the heat exchanger to a transport vessel;

(v) a vapor return flexible conduit for communicating a hydrocarbon vapor formed during offloading from the transport vessel back to the floating liquefaction vessel, wherein the vapor return flexible conduit is in fluid communication with the heat exchanger; and (vi) a floating liquefaction vessel controller for monitoring the dry gas inlet conduit, the heat exchanger, the offload flexible outlet conduit, and the vapor return flexible conduit; and b. a connecting device for connecting the transport vessel to the floating liquefaction vessel, wherein the connecting device comprises:

(i) a connecting mount engaging the connecting device with the floating liquefaction vessel;

(ii) a telescoping walkway comprising an inner walkway telescopically contained within an outer walkway, wherein the inner walkway is configured to extend and retract from the outer walkway when the floating liquefaction vessel and the transport vessel are connected together and are affected by wave motion, current motion, wind motion, transport vessel dynamics, floating liquefaction vessel dynamics, or combinations thereof;

(iii) a walkway offload flexible conduit for flowing the liquefied natural gas from the floating liquefaction vessel; and (iv) a walkway vapor return flexible conduit for flowing the hydrocarbon vapor formed during offloading from the transport vessel back to the floating liquefaction vessel.

20. A vessel for receiving a dry gas, forming a liquefied natural gas, and offloading the liquefied natural gas, the vessel comprising:

a. a floating liquefaction vessel comprising:

(i) an offload flexible outlet conduit for flowing the liquefied natural gas to a transport vessel; and (ii) a vapor return flexible conduit for communicating a hydrocarbon vapor formed during offloading from the transport vessel back to the floating liquefaction vessel; and b. a connecting device for connecting the transport vessel to the floating liquefaction vessel, wherein the connecting device comprises:

(i) a connecting mount engaging the connecting device with the floating liquefaction vessel;

(ii) a telescoping walkway comprising an inner walkway telescopically contained within an outer walkway the telescoping walkway comprising an enclosed space configured for transfer of personnel and equipment between the floating liquefaction vessel and the transport vessel, wherein the inner walkway is configured to extend and retract from the outer walkway when the floating liquefaction vessel and the transport vessel are connected together and are affected by wave motion, current motion, wind motion, transport vessel dynamics, floating liquefaction vessel dynamics, or combinations thereof;

(iii) a walkway offload flexible conduit for flowing the liquefied natural gas from the floating liquefaction vessel; and (iv) a walkway vapor return flexible conduit for flowing the hydrocarbon vapor formed during offloading from the transport vessel back to the floating liquefaction vessel.

* * * * *